US012140325B2

(12) United States Patent
Sato et al.

(10) Patent No.: US 12,140,325 B2
(45) Date of Patent: Nov. 12, 2024

(54) AIR CONDITIONER INCLUDING A CENTRIFUGAL FAN

(71) Applicant: SAMSUNG ELECTRONICS CO., LTD., Suwon-si (KR)

(72) Inventors: Seiji Sato, Yokohama (JP); Shinji Goto, Yokohama (JP); Nozomu Inoue, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 162 days.

(21) Appl. No.: 17/561,219

(22) Filed: Dec. 23, 2021

(65) Prior Publication Data

US 2022/0205650 A1 Jun. 30, 2022

Related U.S. Application Data

(63) Continuation of application No. PCT/KR2021/019680, filed on Dec. 23, 2021.

(30) Foreign Application Priority Data

Dec. 25, 2020 (JP) ..... 2020-217323
Aug. 18, 2021 (JP) ..... 2021-133409

(51) Int. Cl.
*F24F 1/0022* (2019.01)
*F24F 1/0063* (2019.01)

(52) U.S. Cl.
CPC ..... *F24F 1/0022* (2013.01); *F24F 1/0063* (2019.02)

(58) Field of Classification Search
CPC ..... F24F 1/0022; F24F 1/0063; F04D 29/384; F04D 29/281; F05D 2240/303; F05D 2240/304; F05D 2250/185
See application file for complete search history.

(56) References Cited

U.S. PATENT DOCUMENTS 8,784,060 B2 7/2014 Iwata et al.
9,528,374 B2 12/2016 Ikeda et al.
(Continued)

FOREIGN PATENT DOCUMENTS

CN 2420560 Y * 2/2001
CN 103477084 B 11/2017
(Continued)

OTHER PUBLICATIONS

DE102014212561A1 Translation (Year: 2014).*
(Continued)

*Primary Examiner* — Schyler S Sanks
(74) *Attorney, Agent, or Firm* — STAAS & HALSEY LLP

(57) ABSTRACT

The centrifugal fan includes a base plate connected to a rotating shaft of a motor, a plurality of blades joined to a surface of the base plate, and a ring-shaped shroud joined to the plurality of blades to face the base plate. The blade is provided in such a way that a length of one end joint portion joined to the base plate is greater than a length of another end joint portion joined to the shroud, and with respect to a plane perpendicular to a rotation axis, an angle between a first straight line, which connects a leading edge position and a trailing edge position of the one end joint portion, and a straight line passing through a center point of the first straight line and a rotation center is less than an angle between a second straight line, which connects a leading edge position and a trailing edge position of the other end joint portion, and a straight line passing through a center point of the second straight line and the rotation center.

13 Claims, 20 Drawing Sheets

(56) References Cited

U.S. PATENT DOCUMENTS

| | | | | |
|---|---|---|---|---|
| 9,951,782 | B2 | 4/2018 | Kurihara et al. | |
| 9,995,311 | B2 | 6/2018 | Son et al. | |
| 2015/0300367 | A1 | 10/2015 | Lee | |
| 2016/0245298 | A1* | 8/2016 | Ohtaguro | F04D 29/281 |
| 2021/0381513 | A1* | 12/2021 | Takeishi | F04D 17/10 |

FOREIGN PATENT DOCUMENTS

| | | | | | |
|---|---|---|---|---|---|
| CN | 207920972 | U | | 9/2018 | |
| DE | 102014212561 | A1 | * | 2/2015 | F04D 29/326 |
| EP | 174487 | A | * | 3/1986 | F01D 5/141 |
| JP | 2010-53803 | | | 3/2010 | |
| JP | 2013-36444 | A | | 2/2013 | |
| JP | 6695509 | B1 | | 5/2020 | |
| KR | 10-1210696 | | | 12/2012 | |
| KR | 10-2014-0125625 | | | 10/2014 | |
| KR | 10-2014-0131750 | | | 11/2014 | |
| KR | 10-1727901 | B1 | | 4/2017 | |
| KR | 10-1767505 | | | 8/2017 | |

OTHER PUBLICATIONS

EP-174487-A Translation (Year: 1986).*
CN2420560Y Translation (Year: 2001).*
International Search Report dated Apr. 21, 2022 from International Application No. PCT/KR2021/019680.

* cited by examiner

PERSPECTIVE VIEW OF AN EMPHASIS ON ONE BLADE

PERSPECTIVE VIEW OF CENTRIFUGAL FAN

CONFIGURATION WITH PRESSURE SURFACE WITHOUT THICKENING

CONFIGURATION WITH PRESSURE SURFACE WITH THICKENING

INFLOW DIRECTION IN THE VICINITY OF RECIRCULATION FLOW WITHOUT THE RING-SHAPED MEMBER

INFLOW DIRECTION IN THE VICINITY OF RECIRCULATION FLOW WITH THE RING-SHAPED MEMBER

AIR CONDITIONER INCLUDING A CENTRIFUGAL FAN

CROSS-REFERENCE TO RELATED APPLICATION(S)

This application is a continuation application, under 35 U.S.C. § 111(a), of international application No. PCT/KR2021/019680, filed on Dec. 23, 2021, which claims priority to Japanese Patent Application No. 2020-217323 filed on Dec. 25, 2020, and Japanese Patent Application No. 2021-133409 filed on Aug. 18, 2021, in the Japan Patent Office, the disclosures of which are herein incorporated by reference in their entireties

FIELD

The disclosure relates to an air conditioner and a fan provided therefor.

BACKGROUND

A conventional centrifugal fan has a blade shape designed on the premise that air blows only in a centrifugal direction, and as disclosed in Patent Document 1, a shape of a leading edge of the blade against the inflow in an axial direction has been studied, but the design of the basic blade shape has not been done.

Therefore, when the airflow flowing in the axial direction flows into the blade, there are difficulties such as confusion of the airflow or resistance of the airflow due to the shape of the leading edge of the blade that is not adapted to the direction of the airflow.

PATENT DOCUMENT

[Patent Document 1] Japanese Patent Laid-Open No. 2010-53803

SUMMARY

Additional aspects of the disclosure will be set forth in part in the description which follows and, in part, will be obvious from the description, or may be learned by practice of the disclosure.

In accordance with an aspect of the disclosure, an air conditioner includes a housing mountable to or suspendabie from a ceiling and including an air intake port and an air discharge port formed on a portion of the housing, a heat exchanger arranged inside the housing, and a centrigual fan arranged inside the housing to suck air into the housing through the air intake port and discharge air to an outside of the housing through the air discharge port. The centrifugal fan includes a base plate to which shaft of a motor is connected, a plurality of blades joined to the base plate, and a ring-shaped shroud including an opening in a center thereof, the ring-shaped shroud joined to the plurality of blades so that the ring-shaped shroud and the base plate are spaced apart by the plurality of blades to face each other. Each of the plurality of blades includes a leading edge and a trailing edge with respect to a rotation direction of the centrifugal fan. The leading edge includes a rear protruding region formed to retreat and advance toward the rotation direction of the centrifugal fan from a rotation center side toward an outer circumferential side, with respect to a plane perpendicular to a rotation axis of the shaft.

The each of the plurality of blades may include one end joint portion joined to the base plate, and another end joint portion joined to the ring-shaped shroud, and an outer circumferential side end of the other end joint portion may be located in the rotation direction of the centrifugal fan.

The blade may include one end joint portion joined to the base plate, and the other end joint portion joined to the ring-shaped shroud, and an outer circumferential side end of the other end joint portion may be located in a direction opposite to the rotation direction of the centrifugal fan t.

Each of the plurality of blades includes multiple rear protruding regions.

The leading edge may include a region continuous from the rear protruding region toward the outer circumferential side, the region formed to retract toward the outer circumferential side.

With respect to a meridian plane passing through the rotation axis, the leading edge may include a first region in which an angle formed with the rotation axis is constant from the rotation center side toward the outer circumferential side, a second region continuous from the first region to the outer circumferential side, the second region in which an angle formed with the rotation axis is reduced and then increased, and a third region continuous from the second region to the outer circumferential side, the third region in which an angle formed with the rotation axis is greater than 90 degrees.

An angle between the leading edge and the rotation axis may be an angle formed between a tangent line at one point of the leading edge and the rotation axis, the angle facing a suction side of the centrifugal fan.

An angle between the leading edge and the rotation axis in the first region may be greater than or equal to 5 degrees, but less than or equal to 30 degrees.

The air conditioner may further include a bell mouth provided inside the shroud and including an inner diameter being gradually expanded toward an upstream side, and a downstream end of the bell mouth may be located at a position opposite to the third region.

With respect to a meridian plane passing through the rotation axis, the leading edge may include a first region in which an angle formed with the rotation axis is constant or increased from the rotation center side toward the outer circumferential side, and a second region continuous from the first region to the outer circumferential side, the second region in which an angle formed with the rotation axis is greater than 90 degrees before being joined to the shroud.

The air conditioner may further include a bell mouth provided inside the shroud and including an inner diameter being gradually expanded toward an upstream side, and a downstream end of the bell mouth may be located at a position opposite to the second region.

The trailing edge may be formed to be inclined to allow a shroud side of the trailing edge to face a direction opposite to the rotation direction of the centrifugal fan.

The trailing edge may include a region in which an angle between the trailing edge and the rotation axis is reduced toward the shroud side of the trailing edge.

The air conditioner may further include a bell mouth provided inside the shroud and including an inner diameter being gradually expanded toward an upstream side, and the bell mouth may include a ring-shaped member provided on an outer circumference of the bell mouth so as to be adjacent to an inlet portion of the shroud.

The blade may include one end joint portion joined to the base plate, and the other end joint portion joined to the shroud. A length of the one end joint portion may be greater than a length of the other end joint portion. With respect to a plane perpendicular to the rotation axis, an angle between a first straight line, which connects a leading edge position and a trailing edge position of the one end joint portion, and a straight line passing through a center point of the first straight line and the rotation center may be less than an angle between a second straight line, which connects a leading edge position and a trailing edge position of the other end joint portion, and a straight line passing through a center point of the second straight line and the rotation center.

In accordance with another aspect of the disclosure, an air conditioner includes a housing mounted to a ceiling or suspended from a ceiling and including an air intake port and an air discharge port formed on a lower portion of the housing, a heat exchanger arranged inside the housing, a centrifugal fan arranged inside the housing to suck air into the housing through the air intake port and discharge air to the outside of the housing through the air discharge port, and a bell mouth provided inside the shroud and including an inner diameter being gradually expanded toward an upstream side. The centrifugal fan includes a base plate to which a motor is connected, a plurality of blades joined to the base plate, and a ring-shaped shroud joined to the plurality of blades to face the base plate and including an opening in a center thereof. Each of the plurality of blades includes a leading edge and a trailing edge. The trailing edge is formed to be inclined to allow a shroud side of the trailing edge to face a direction opposite to a rotation direction.

The trailing edge may include a region in which an angle between the trailing edge and the rotation axis is reduced toward the shroud side of the trailing edge.

The air conditioner may further include a bell mouth provided inside the shroud and including an inner diameter being gradually expanded toward an upstream side, and the bell mouth may include a ring-shaped member provided on an outer circumference of the bell mouth so as to be adjacent to an inlet portion of the shroud.

In accordance with another aspect of the disclosure, an air conditioner includes a housing mounted to a ceiling or suspended from a ceiling and including an air intake port and an air discharge port formed on a lower portion of the housing, a heat exchanger arranged inside the housing, and a centrifugal fan arranged inside the housing to suck air into the housing through the air intake port and discharge air to the outside of the housing through the air discharge port. The centrifugal fan includes a base plate to which a motor is connected, a plurality of blades joined to the base plate, and a ring-shaped shroud joined to the plurality of blades to face the base plate and including an opening in a center thereof. The blade includes one end joint portion joined to the base plate, and the other end joint portion joined to the shroud. A length of the one end joint portion is greater than a length of the other end joint portion, With respect to a plane perpendicular to the rotation axis, an angle between a first straight line, which connects a leading edge position and a trailing edge position of the one end joint portion, and a straight line passing through a center point of the first straight line and the rotation center is less than an angle between a second straight line, which connects a leading edge position and a trailing edge position of the other end joint portion, and a straight line passing through a center point of the second straight line and the rotation center.

In accordance with another aspect of the disclosure, a centrifugal fan includes a base plate including a boss portion to which a rotating shaft of a motor is connected at a center thereof, a plurality of blades joined to one surface of the base plate and arranged at regular intervals in a circumferential direction, a ring-shaped shroud joined to the plurality of blades to face the base plate and including an opening in a center thereof, and a bell mouth provided inside the shroud and including an inner diameter being gradually expanded toward an upstream side. The blade is provided in such a way that a length of one end joint portion joined to the base plate is greater than a length of the other end joint portion joined to the shroud, and with respect to a plane perpendicular to a rotation axis, an angle between a first straight line, which connects a leading edge position and a trailing edge position of the one end joint portion, and a straight line passing through a center point of the first straight line and a rotation center is less than an angle between a second straight line, which connects a leading edge position and a trailing edge position of the other end joint portion, and a straight line passing through a center point of the second straight line and the rotation center.

As for the centrifugal fan configured as described above, because an axial flow blade that smoothly receives the air flowing in the axial direction is added to the rotation center side, which is the front of the conventional centrifugal blade, the air flow may be smoothly introduced to the blade. Accordingly, it is possible to suppress the generation of turbulence, thereby reducing noise and at the same time, improving the blowing efficiency.

In order to actively suck air in the outer circumference of the blade and to increase an outlet wind speed on the shroud side so as to equalize distribution of the wind speed, it is appropriate that the leading edge of the blade includes a region retreating and then advancing in the rotation direction from a rotation center side toward an outer circumferential side, or a region in which an amount of the retreat is gradually reduced in the rotation direction from the rotation center side toward an outer circumferential side with respect to a plane perpendicular to the rotation axis.

By the configuration, it is possible to equalize the outlet wind speed of the fan having a tendency to be biased toward the base plate, and to alleviate the collision of the airflow to the heat exchanger or the like arranged on the outlet side, thereby reducing resistance or reducing noise.

In order to further equalize the outlet wind speed of the fan, it is appropriate that the leading edge of the blade includes a region, in which an amount of the retreat is gradually increased in the rotation direction, on the outer circumferential side of the region retreating and then advancing in the rotation direction from the rotation center side toward the outer circumferential side or on the outer circumferential side of the region in which an amount of the retreat is gradually reduced in the rotation direction from the rotation center side toward an outer circumferential side, with respect to a plane perpendicular to the rotation axis.

The blade may have a twisted shape to allow an outer circumferential side end of the other end joint portion joined to the shroud to be located in a direction opposite to the rotation direction than an outer circumferential side end of one end of the joint portion joined to the base plate.

By the configuration, because the outer circumferential surface becomes an angle toward the shroud side in the vicinity of the outlet of the blade, the air flow is extruded in the shroud direction and thus the outlet wind speed is more equalized.

It is appropriate that the leading edge of the blade includes a region in which an angle with the rotation axis is reduced and then constant or increased, or constant or increased with respect to a meridian plane passing through the rotation axis.

As for the configuration, with respect to the airflow, which is concentrated and introduced in the vicinity of the outer circumference along the bell mouth, it is possible to increase a length of the blade to the outlet so as to gently increase a pressure thereof and to blow the air by the region in which the angle with the rotation is reduced and then increased or increased without the reduction.

It is appropriate that the leading edge of the blade includes a region in which an angle formed with the rotation axis is greater than 90 degrees before being joined to the shroud with respect to the meridian plane passing through the rotation axis, and a downstream end of the bell mouth is located at a position opposite to the region.

By the configuration, the blade may not interfere with the bell mouth and thus it is possible to increase the length of the blade in the vicinity of the shroud.

In the vicinity of the leading edge, it is required to consider a recirculation flow in which the air blown out from the outlet of the centrifugal fan is introduced into a gap between the shroud and the bell mouth. Because the recirculation flow has a locally strong axial velocity component, a difficulty in that an inlet angle of the blade 22 does not match the recirculation flow may occur.

In order to properly ease the difficulty, it is appropriate that leading edge of the blade is provided in such a way that a thickness of a region, in which the shroud and the bell mouth overlap in the radial direction, to be greater than a thickness of a region in which the shroud and the bell mouth 24 do not overlap in the radial direction, with respect to the meridian plane passing through the rotation axis.

By the configuration, it is possible to substantially change an inlet angle of a camber line of the blade by thickening the pressure surface of the blade. As a result, it is possible to match the recirculation flow to the blade, thereby suppressing the separation of the airflow and thereby reducing the noise.

In order to equalize the outlet wind speed without reducing the flow rate processed on the shroud side, it is appropriate that the trailing edge of the blade is inclined to allow the shroud side to face the opposite rotation direction.

As for the trailing edge of the blade, it is appropriate that the trailing edge of the blade includes a region in which an angle between the trailing edge and the rotation axis is reduced toward the shroud in order to suppress the flow concentration to a connection portion with the shroud.

It is appropriate that the trailing edge of the blade is provided in such a way that an angle between a tangent line (an extension line in the case of a straight line) from the rotation center side and the rotation axis is greater than or equal to −60 degrees, but less than or equal to 60 degrees (appropriately, greater than or equal to 5 degrees, but less than or equal to 30 degrees).

Further, it may be considered that a ratio (A2/A1) of an inlet area A1 of the shroud and an outlet area A2 of the centrifugal fan is greater than or equal to 1.1, but is less than or equal to 1.5.

As described above, the air blown out from the outlet of the centrifugal fan becomes the recirculation flow and is introduced into between the shroud and the bell mouth.

In order to reduce the recirculation flow, it is appropriate that the centrifugal fan of the embodiment further includes a ring-shaped member provided by opening a gap downward from the inlet of the shroud in the outer circumference of the bell mouth.

By providing the ring-shaped member, it is possible to prevent the recirculation flow from being introduced into the gap between the shroud and the bell mouth. As a result, the recirculation flow is reduced and an inflow angle of the recirculation flow is inclined in the direction opposite to the rotation, and thus the recirculation flow easily flows along the blade.

An indoor unit for an air conditioner using the centrifugal fan is an embodiment of the disclosure.

DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Therefore, it is an aspect of the disclosure to provide a centrifugal fan capable of improving blowing efficiency and reducing noise by suppressing the generation of turbulence.

Hereinafter an embodiment of an indoor unit for an air conditioner using a centrifugal fan according to the disclosure will be described with reference to the drawings.

1. Indoor Unit for Air Conditioner

An indoor unit 100 for an air conditioner according to the embodiment includes a housing 1 that is a ceiling-mounted type or a ceiling-installed type that is suspended from a ceiling, and including an air intake port H1 and an air discharge port H2 formed on a lower surface thereof. The air intake port H1 is formed in a central portion of the lower surface of the housing 1, and four air discharge ports H2 are formed to surround the air intake port H1. In this case, the four air discharge ports H2 are formed to correspond to the four sides of the quadrangle when viewed in a plan view.

In addition, inside the housing 1 of the indoor unit 100 for the air conditioner, a centrifugal fan 2 configured to suck air from the air intake port H1 and blow the air out to the air discharge port H2, and a heat exchanger 3 in contact with an airflow generated by the centrifugal fan 2 are accommodated. The heat exchanger 3 is arranged to surround the centrifugal fan 2. Accordingly, the air sucked in from the air intake port H1 by the centrifugal fan 2 is heat-exchanged by the heat exchanger 3 and then is blown out into a room through the air discharge port H2.

2. Centrifugal Fan

Figure 1:
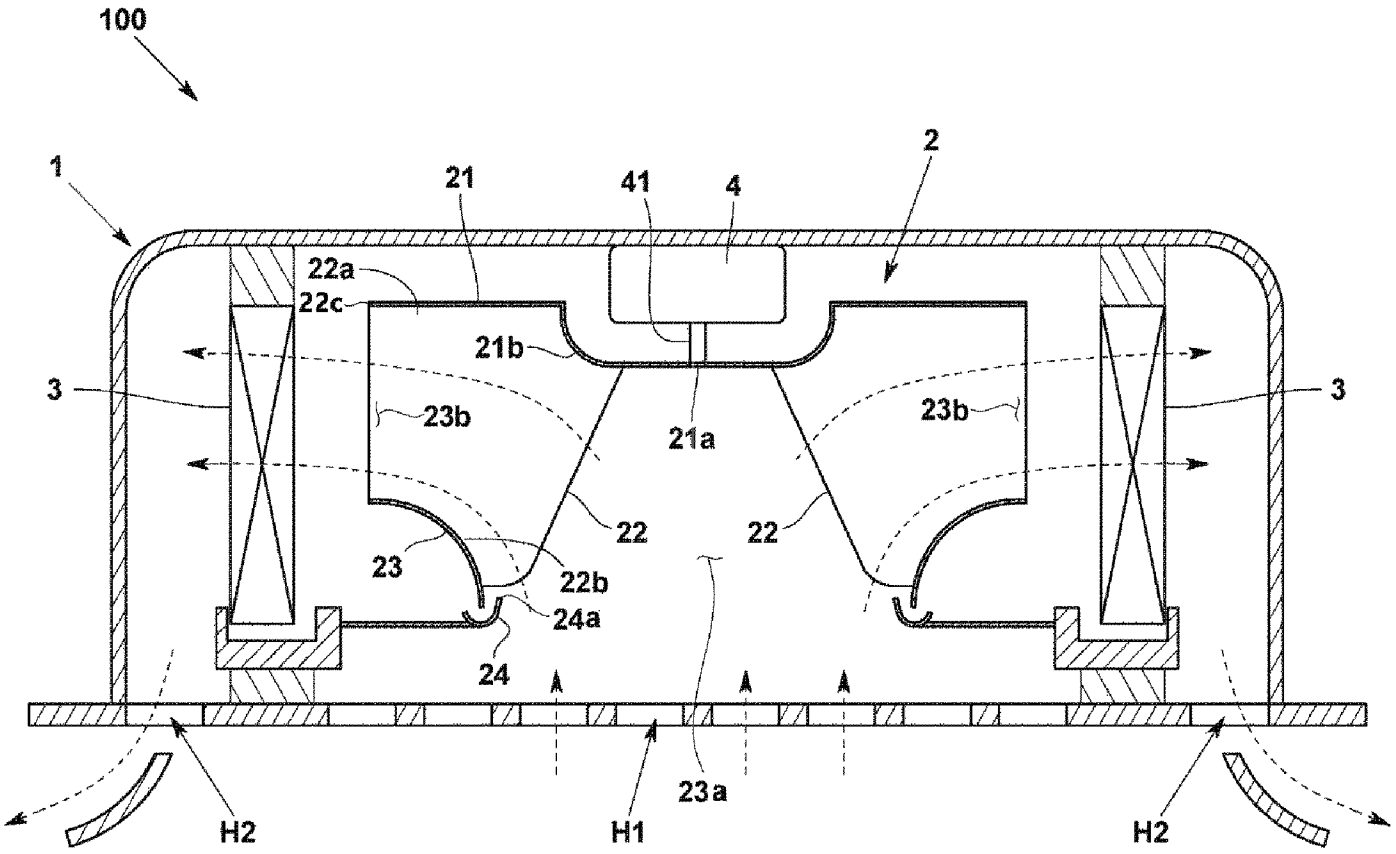
FIG. 1 is a cross-sectional view schematically illustrating a configuration of an indoor unit for an air conditioner according to an embodiment of the disclosure.
Figure 2:
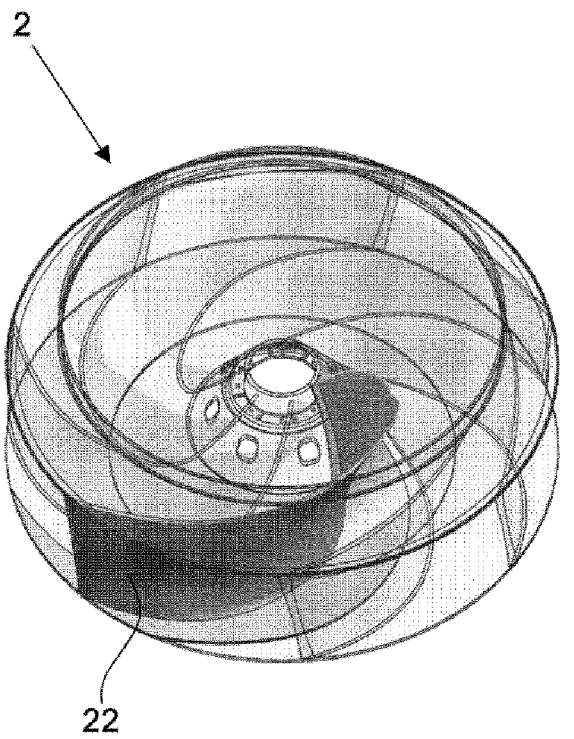
FIG. 2 is a perspective view of a centrifugal fan according to an embodiment and a perspective view of an emphasis on one blade.
Figure 2:
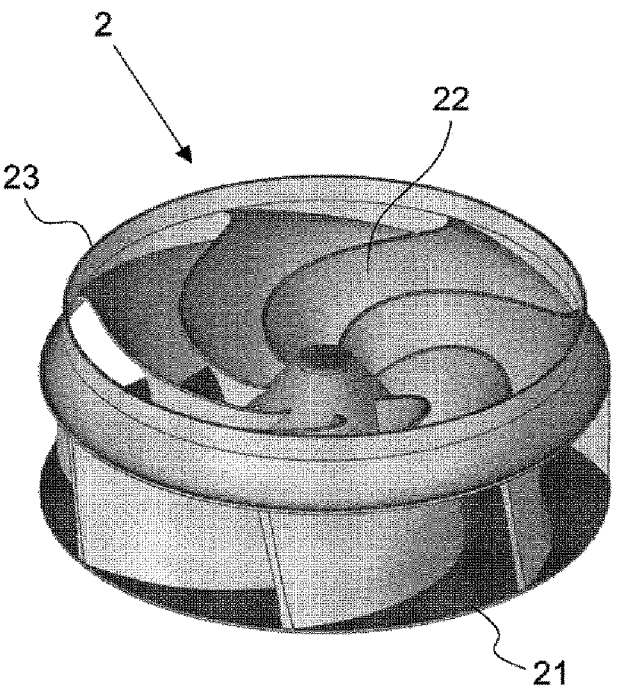

The centrifugal fan 2 of the embodiment includes a base plate 21, a plurality of blades 22, a shroud 23, and a bell mouth 24 as illustrated in FIG. 1.

The circular-shaped base plate 21 includes a boss portion 21*a* in which a rotating shaft 41 of a motor 4 is connected to a center thereof. A protrusion 21*b* is formed in the central portion of the base plate 21, and accordingly, the base plate 21 forms a mountain shape.

The plurality of blades 22 is joined to one surface, on which the protrusion 21*b* is formed, of the base plate 21, and is arranged at regular intervals in a circumferential direction. The plurality of blades 22 is formed from an outer circumferential surface of the protrusion 21*b*, which is formed in the central portion of the base plate 21, to an outer circumference 21*c* of the base plate 21. A specific configuration of the blade 22 will be described later.

The shroud 23 is arranged to face the base plate 21 and formed in a ring shape joined to other end of the plurality of blades 22, and the shroud 23 includes an opening 23*a* in a center thereof. Air is sucked in from the central opening 23*a* of the shroud 23. In addition, air is blown out through an opening 23*b* formed between the shroud 23 and the base plate 21.

The bell mouth 24 is provided in such a way that a downstream end 24*a* is provided inside the shroud 23, and an inner diameter thereof is gradually expanded toward an upstream side.

3. Specific Configuration of Blade

The blade 22 of the embodiment may include a leading edge LE (refer to FIG. 3) corresponding to a front end of the blade 22, and a trailing edge 22*z* (refer to FIG. 15) corresponding to a rear end of the blade 22. In response to the blade 22 being rotated, air may be guided from the leading edge LE side to the trailing edge 22*z* side.

In addition, the blade 22 may include one end joint portion 22*a* (refer to FIG. 3) corresponding to a portion joined to the base plate 21, and the other end joint portion 22*b* (refer to FIG. 3) corresponding to a portion joined to the shroud 23.

Figure 3:
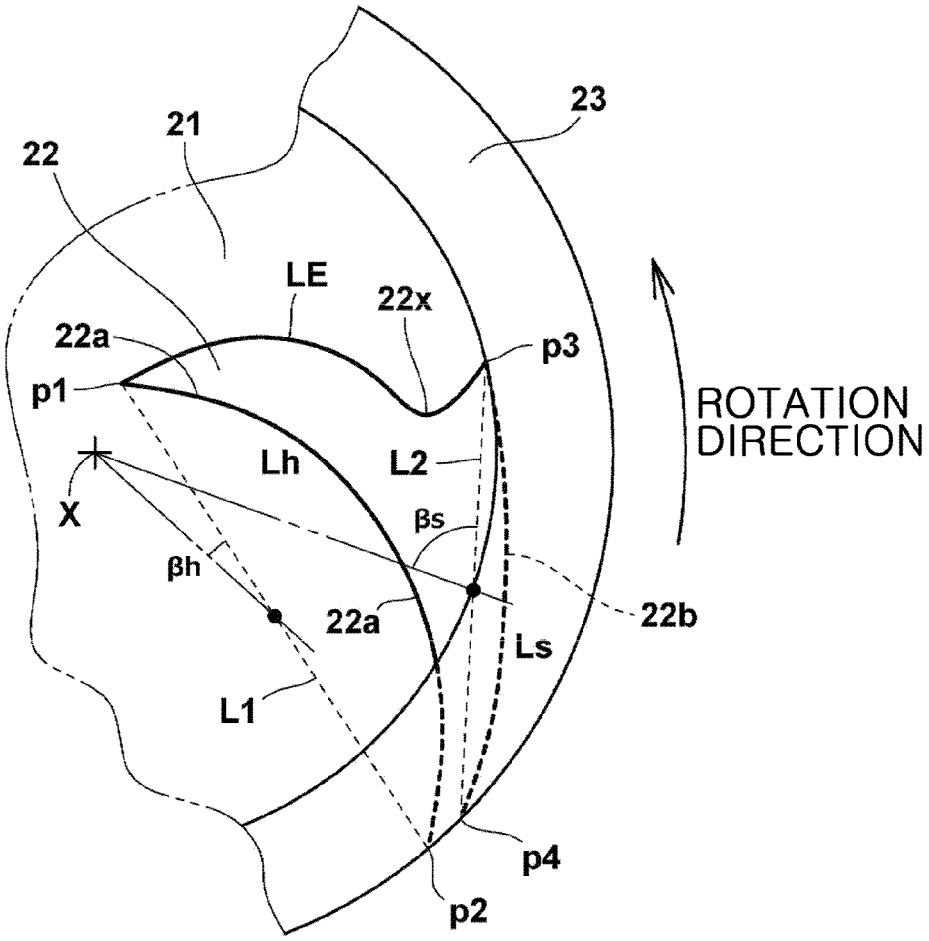
FIG. 3 is a schematic diagram illustrating a shape of a blade projected on a plane perpendicular to a rotation axis according to an embodiment of the disclosure.

As illustrated in FIG. 3, the blade 22 of the embodiment is provided in such a way that a length Lh of the one end joint portion 22*a* joined to the base plate 21 is greater than a length Ls of the other end joint portion 22*b* joined to the shroud 23.

In addition, with respect to a plane perpendicular to a rotation axis C of the rotating shaft 41, the blade 22 is provided in such a way that an angle βh between a first straight line L1, which connects a leading edge position p1 and a trailing edge position p2 of the one end joint portion 22*a*, and a straight line passing through a center point of the first straight line L1 and a rotation center X is less than an angle βs between a second straight line L2, which connects a leading edge position p3 and a trailing edge position p4 of the other end joint portion 22*b*, and a straight line passing through a center point of the second straight line L2 and the rotation center X.

In addition, an outer circumferential side end of the other end joint portion 22*b* joined to the shroud 23 may be located in the rotation direction than an outer circumferential side end of the one end joint portion 22*a* joined to the base plate 21.

Figure 4:
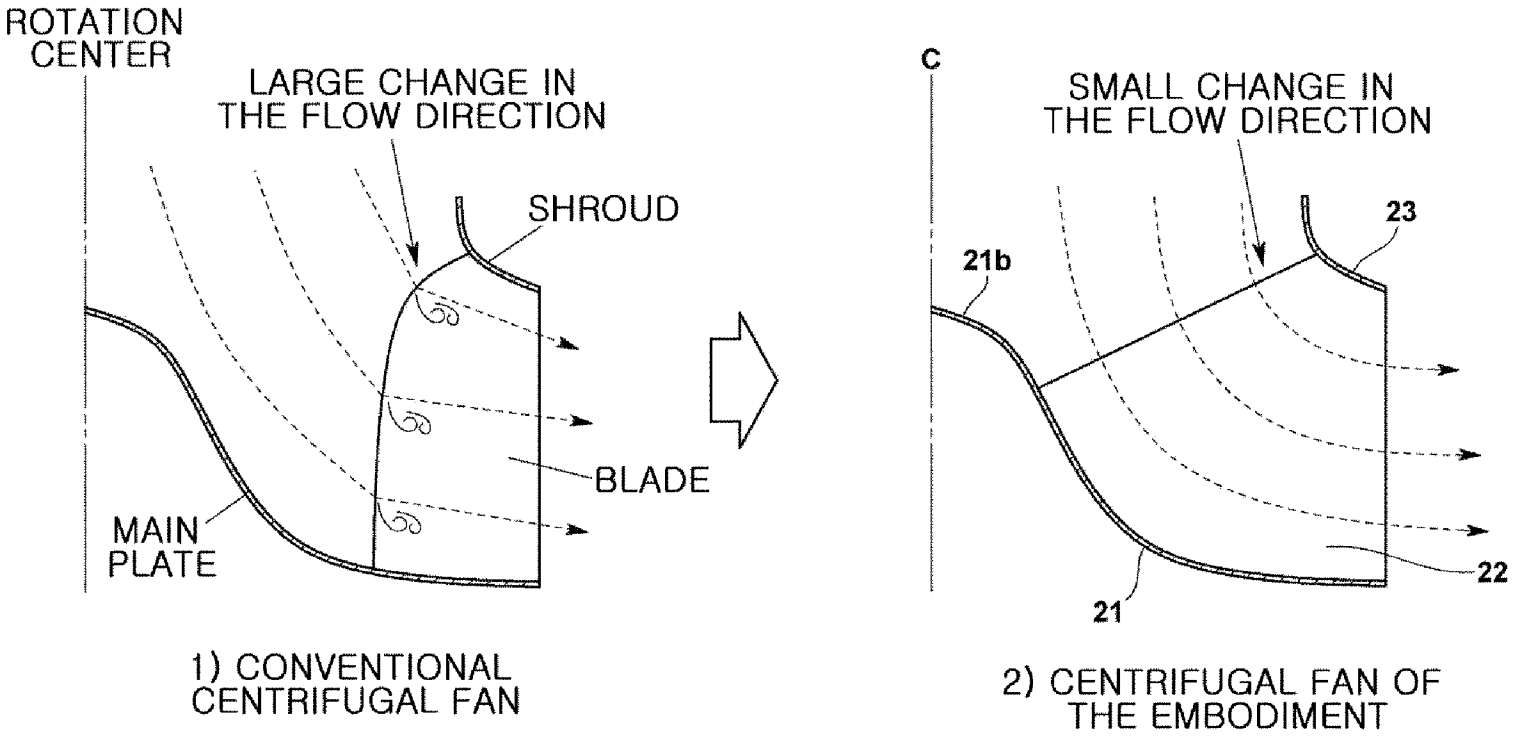
FIG. 4 is a view schematically illustrating an airflow of a conventional centrifugal fan and the centrifugal fan of the embodiment.

A surface facing a rear side of the rotation direction in an inlet portion (suction side portion) of the blade 22 faces a suction side and a direction opposite to the rotation like an axial fan. Accordingly, as illustrated in FIG. 4, a change, which is in a flow direction at a portion where the airflow is introduced into the blade 22, may be less than that of the conventional centrifugal fan, and thus the airflow may be smoothly introduced into the blade 22.

In addition, with respect to the plane perpendicular to the rotation axis C, as illustrated in FIG. 3, the leading edge LE of the blade 22 includes a region 22*x* that retreats and then advances in the rotation direction from the rotation center X side toward the outer circumferential side. That is, the plane perpendicular to the rotation axis C, the region 22*x* in the leading edge LE of the blade 22 according to the embodiment includes a configuration of retreating and then advancing in the rotation direction from the rotation center X side toward the outer circumferential side. The region 22*x* may be referred to as a rear protruding region.

Figure 5:
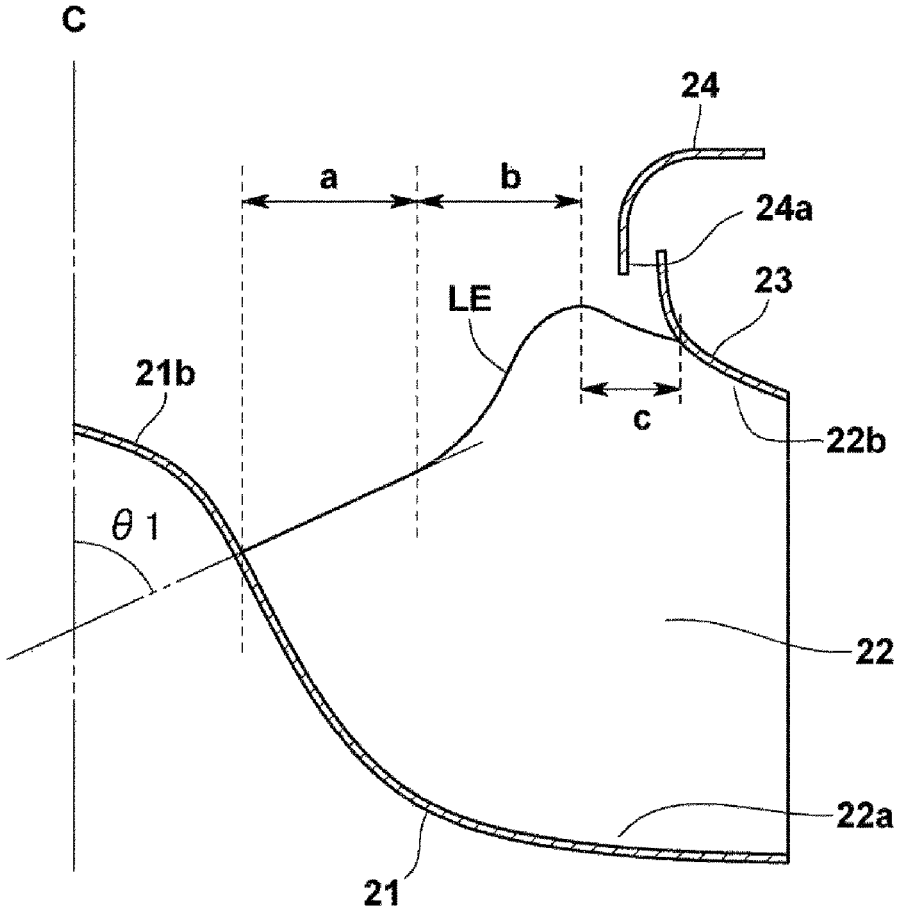
FIG. 5 is a schematic diagram illustrating a shape of the blade projected on a meridian plane passing through the rotation axis according to an embodiment of the disclosure.

With respect to a meridian plane passing through the rotation axis C, as illustrated in FIG. 5, the leading edge LE of the blade 22 may include a first region a in which an angle θ1 formed with the rotation axis C is constant from the rotation center side toward the outer circumferential side, and a second region b region continuous from the first region a to the outer circumferential side, and in which an angle θ1 formed with the rotation axis is reduced and then increased. With respect to the meridian surface passing through the rotation axis C, the angle θ1 formed with the rotation axis C is an angle formed between a tangent line (an extension line in the case of a straight line) from the rotation center side and the rotation axis C, and an angle facing the suction side with the rotation axis C, that is, an angle formed on the suction side with respect to the rotation axis C.

Figure 6:
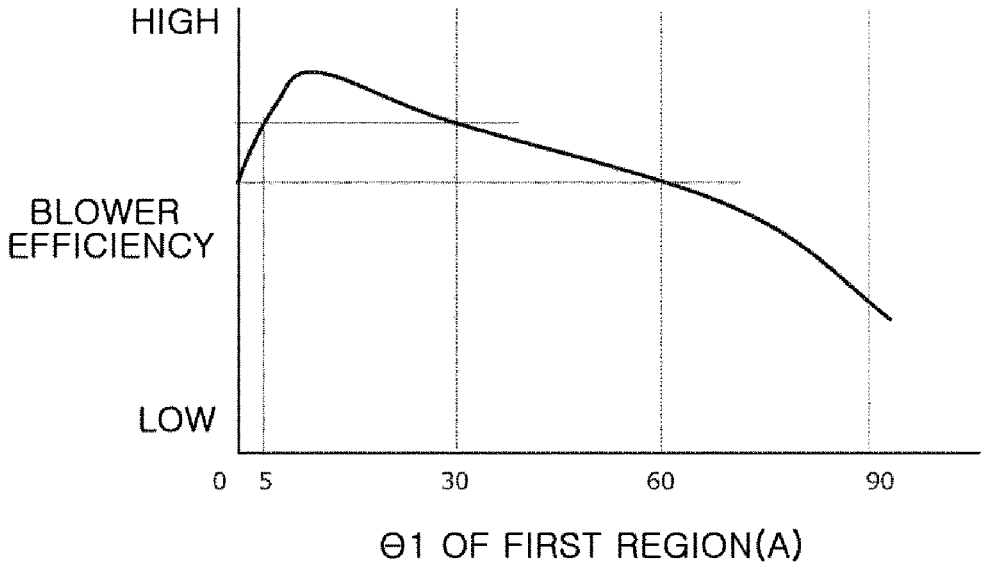
FIG. 6 is a simulation result illustrating blowing efficiency according to an angle of a first region a according to an embodiment of the disclosure.

In the first region a, the angle θ1 between the tangent line and the rotation axis C from the rotation center side is greater than or equal to −60 degrees, but less than or equal to 60 degrees. It is appropriate that the angle θ1 is greater than or equal to 5 degrees, but is less than or equal to 30 degrees. In a condition in which the angle θ1 of the first region a is changed from 0 degrees to 90 degrees (in the case of the blade configuration of FIG. 5), the blowing efficiency is as illustrated in FIG. 6. As can be seen from FIG. 6, it can be seen that the blowing efficiency becomes remarkable at greater than or equal to 5 degrees, but less than or equal to 30 degrees. Further, a ratio (A2/A1) of an inlet area A1 of the shroud 23 (an area of the opening 23*a* in the center of the shroud) and an outlet area A2 of the centrifugal fan 2 (an area of the opening 23*b* formed between the shroud 23 and the base plate 21) is greater than or equal to 1.1, but is less than or equal to 1.5.

Figure 7:
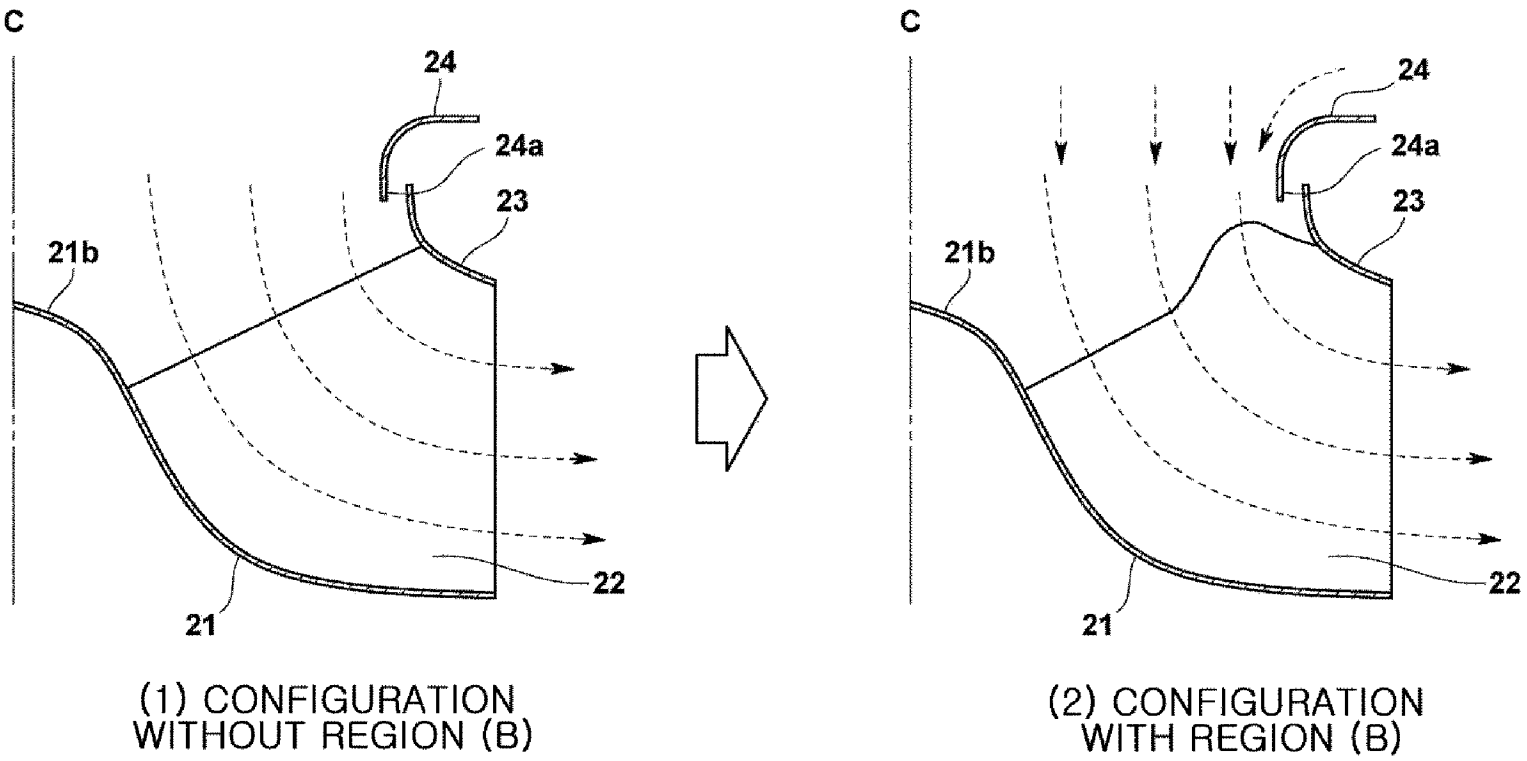
FIG. 7 is a view schematically illustrating the airflow according to the presence or absence of a second region b according to an embodiment of the disclosure.

In addition, in comparison with the configuration without the second region b as illustrated in FIG. 7, with respect to the airflow, which is concentrated and introduced in the vicinity of the outer circumference along the bell mouth 24, it is possible to increase a length of the blade 22 to the outlet so as to gently increase a pressure thereof and to blow the air by the second region b.

In addition, with respect to the meridian plane passing through the rotation axis C, as illustrated in FIG. 5, the leading edge LE of the blade 22 may include a third region c continuous from the second region b to the outer circumferential side, and in which an angle θ1 formed with the rotation axis is greater than 90 degrees before being joined to the shroud 23. In addition, a downstream end 24*a* of the bell mouth 24 is located at a position opposite to the third region c.

Figure 8:
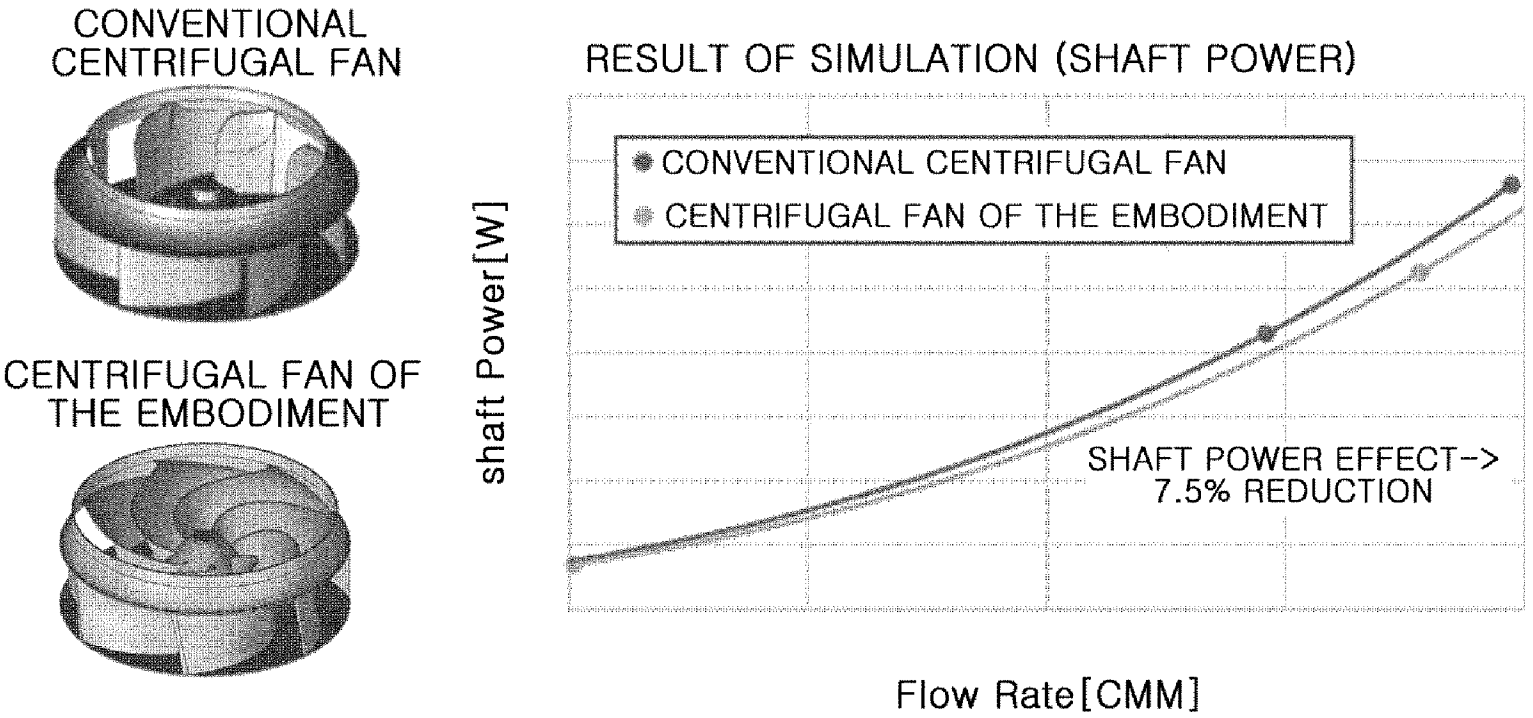
FIG. 8 is a simulation result illustrating a shaft power reduction effect of the centrifugal fan of the embodiment with respect to the conventional centrifugal fan.

Next, FIG. 8 illustrates the simulation result of the shaft power reduction effect of the centrifugal fan according to the embodiment compared to the conventional centrifugal fan. A horizontal axis of FIG. 8 is the flow rate [CMM], and a vertical axis is the shaft power [W]. As can be seen from FIG. 8, the shaft power of the centrifugal fan of the embodiment is reduced by 7.5% compared to the conventional centrifugal fan.

4. Effects of the Embodiment

As for the indoor unit 100 for an air conditioner configured as described above, because an axial flow blade that smoothly receives the air flowing in the axial direction is added to the rotation center side, which is the front of the conventional centrifugal blade, the airflow may be smoothly introduced to the blade 22. Accordingly, it is possible to suppress the generation of turbulence, thereby reducing noise and at the same time, improving the blowing efficiency.

Because the leading edge of the blade 22 includes the region that retreats and then advances in the rotation direction from the rotation center side toward the outer circumferential side with respect to the plane perpendicular to the rotation axis C, it is possible to suction actively air in the outer circumferential portion of the blade 22 so as to increase the outlet wind speed of the shroud 23 side, thereby equalizing distribution of the wind speed. Accordingly, it is possible to reduce the resistance and noise by alleviating the collision of the airflow to the heat exchanger 3 or the like arranged on the outlet side of the centrifugal fan 2.

The leading edge LE of the blade 22 includes the first region a in which the angle θ1 with the rotation axis is constant from the end of the rotation center side toward the outer circumferential side, and the second region b continuous from the first region a to the outer circumferential side, and in which the angle θ1 is reduced and then increased or increased without a reduction. Therefore, with respect to the airflow, which is concentrated and introduced in the vicinity of the outer circumference along the bell mouth 24, it is possible to increase the length of the blade 22 to the outlet so as to gently increase the pressure thereof and to blow the air by the second region b.

The leading edge LE of the blade 22 includes the third region c continuous from the second region b to the outer circumferential side, and in which the angle θ1 is greater than 90 degrees before being joined to the shroud 23. The downstream end 24*a* of the bell mouth 24 is located at a position opposite to the third region c. Therefore, the blade 22 may not interfere with the bell mouth 24 and thus it is possible to increase the length of the blade 22 in the vicinity of the shroud 23.

5. Other Modified Embodiment

In addition, the disclosure is not limited to the above embodiment.

Figure 9:
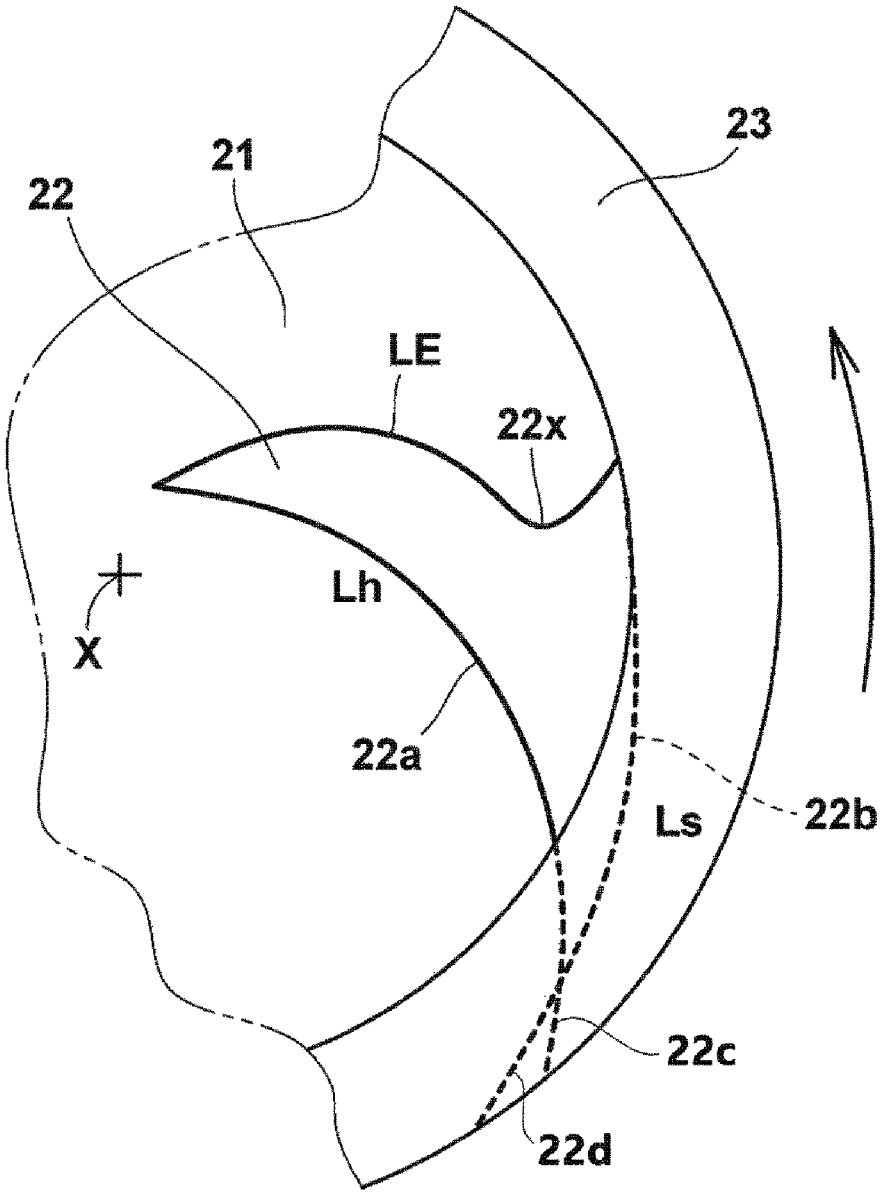
FIG. 9 is a schematic diagram illustrating a shape of a blade projected on a plane perpendicular to a rotating axis according to a modified embodiment of the disclosure.

For example, as illustrated in FIG. 9, the blade 22 has a twisted shape to allow an outer circumferential side end portion 22*d* of the other end joint portion 22*b* joined to the shroud 23 to be located in a direction opposite to the rotation direction than an outer circumferential side end portion 22*c* of one end of the joint portion 22*a* joined to the base plate 21.

In the case of the configuration, because the outer circumferential surface becomes an angle toward the shroud 23 side in the vicinity of the outlet of the blade 22, the airflow may be pushed toward the shroud 23 side and thus the airflow may be more equalized than the outlet wind speed.

Figure 10:
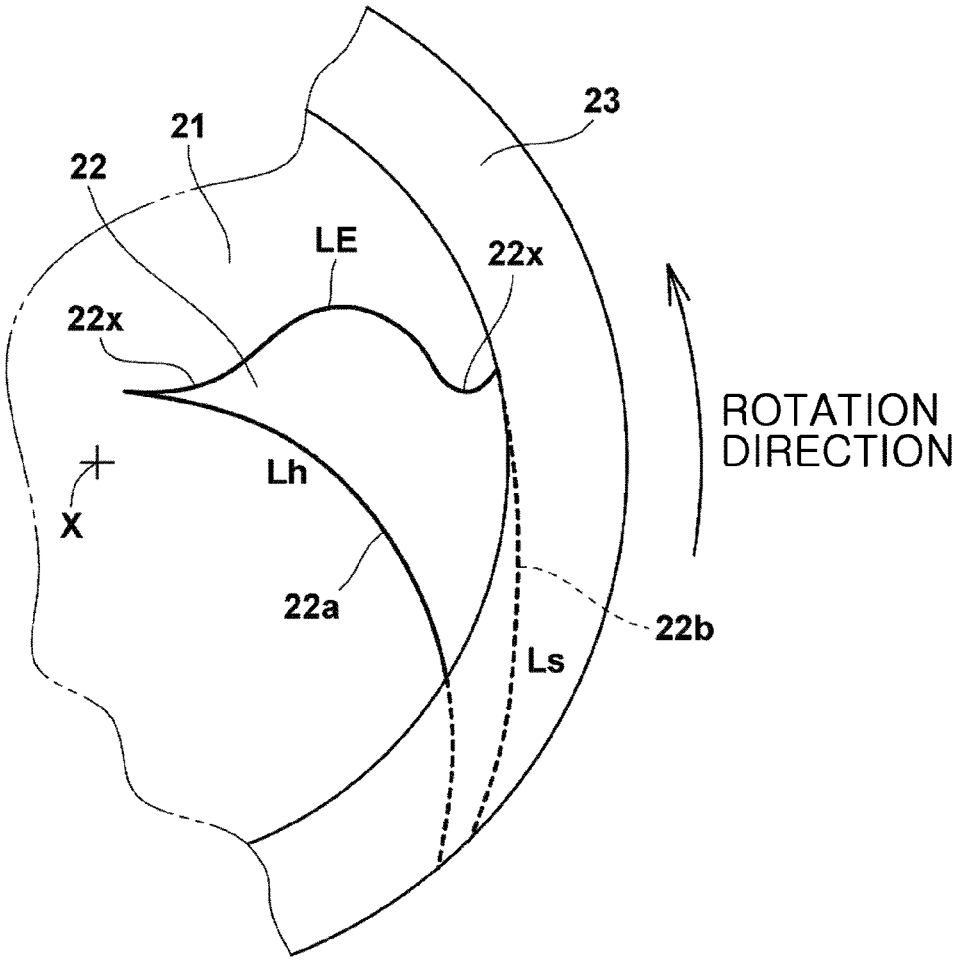
FIG. 10 is a schematic diagram illustrating a shape of a blade projected on a plane perpendicular to a rotation axis according to a modified embodiment of the disclosure.

In addition, as illustrated in FIG. 10, with respect to the plane perpendicular to the rotation axis C, the leading edge LE of the blade 22 may include a plurality of region 22*xs* that retreats and then advances in the rotation direction from the rotation center X side toward the outer circumferential side. FIG. 10 illustrates an example of forming the region 22*xs* retreating and then advancing in the rotation direction on the rotation center X side and the outer circumferential side in the leading edge LE of the blade 22.

Figure 11:
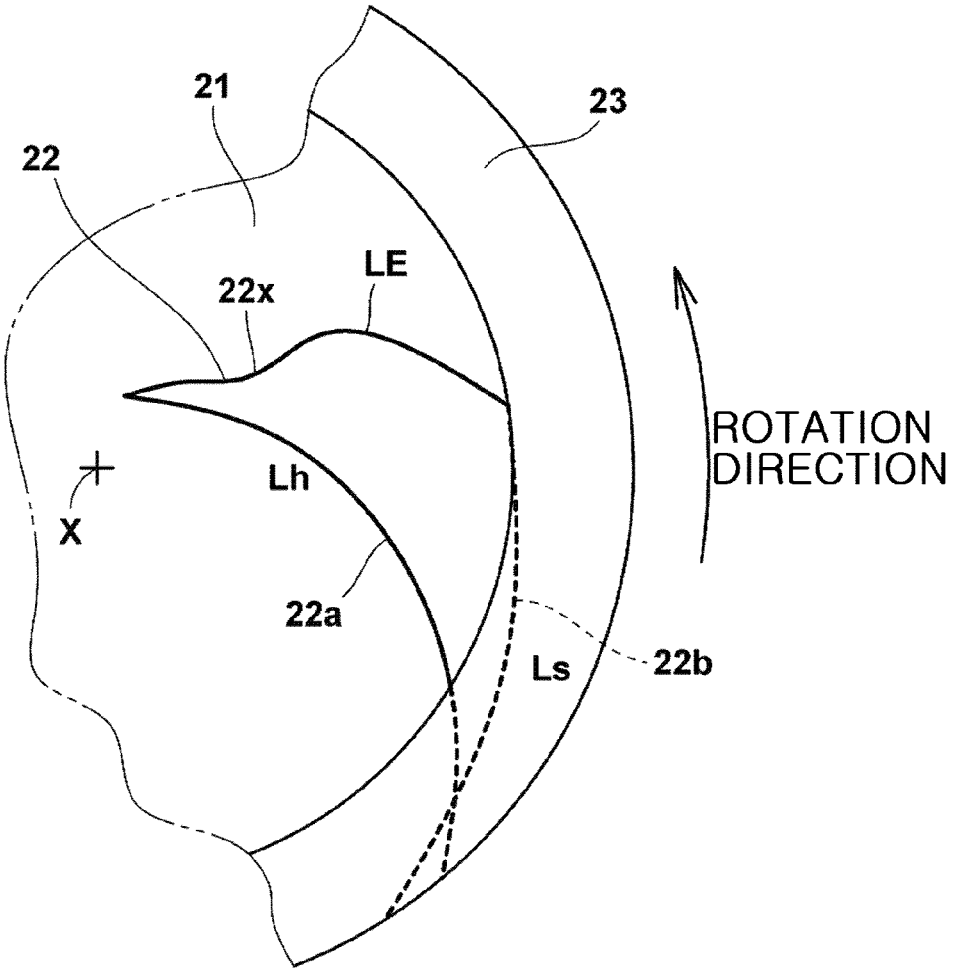
FIG. 11 is a schematic diagram illustrating a shape of a blade projected on a plane perpendicular to a rotation axis according to a modified embodiment of the disclosure.

In addition, in the above embodiment, the region 22*x* at the leading edge LE of the blade 22 is a configuration that is changed to retreat and then advance in the rotation direction from the rotation center X side toward the outer circumferential side, but the region 22*x* may be configured in such a way that the retreat (i.e., an amount of retreat) is gradually reduced and then increased again in the rotation direction from the rotation center X side toward the outer circumferential side, as illustrated in FIG. 11. That is, from the rotation center X side toward the outer circumferential side, the region 22*x* may be changed to retreat and advance, and then retreat again in the rotation direction.

Figure 12:
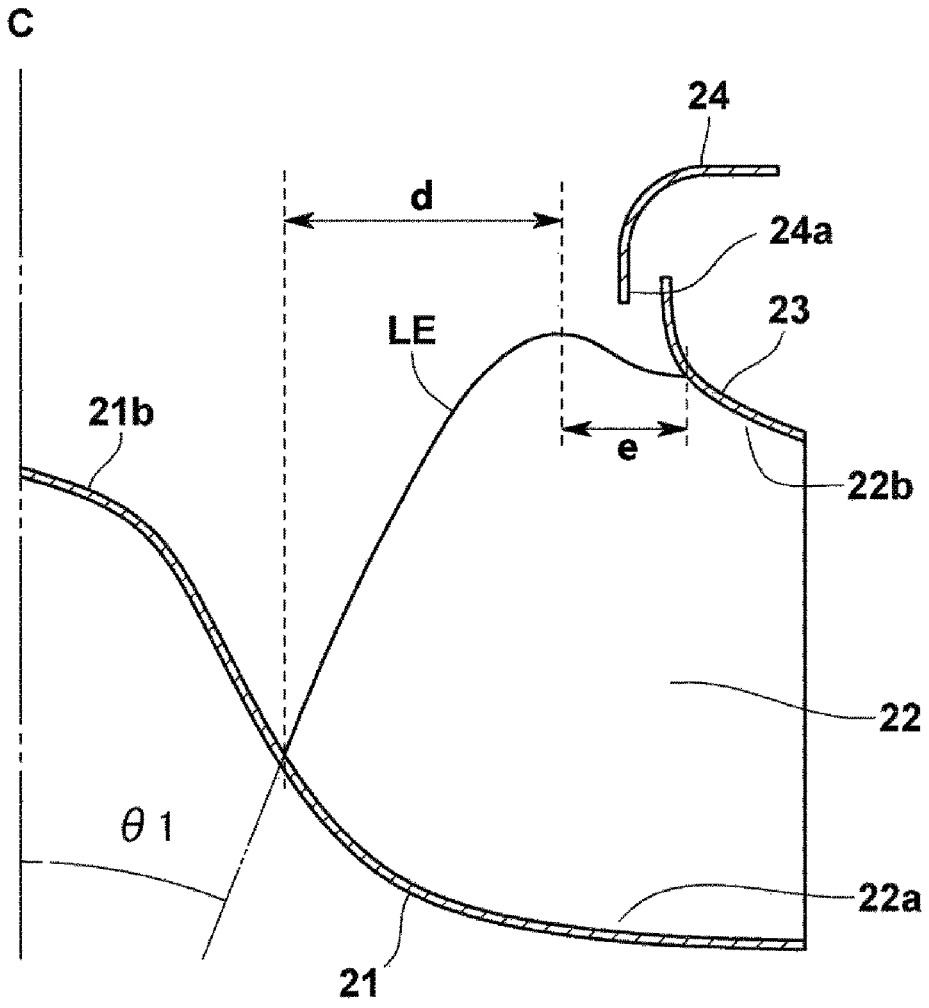
FIG. 12 is a schematic diagram illustrating a shape of a blade projected on a meridian plane passing through a rotation axis according to a modified embodiment of the disclosure.

In addition, with respect to the meridian plane passing through the rotation axis C, as illustrated in FIG. 12, the leading edge LE of the blade 22 may include a first region d in which an angle θ1 with the rotation axis C is constant or is increased without the reduction. Further, the leading edge LE of the blade 22 includes a second region e continuous from the first region d to the outer circumferential side and in which an angle θ1 formed with the rotation axis exceeds 90 degrees before being joined to the shroud 23. In addition, the downstream end 24*a* of the bell mouth 24 is located at a position opposite to the second region e.

Figure 13:
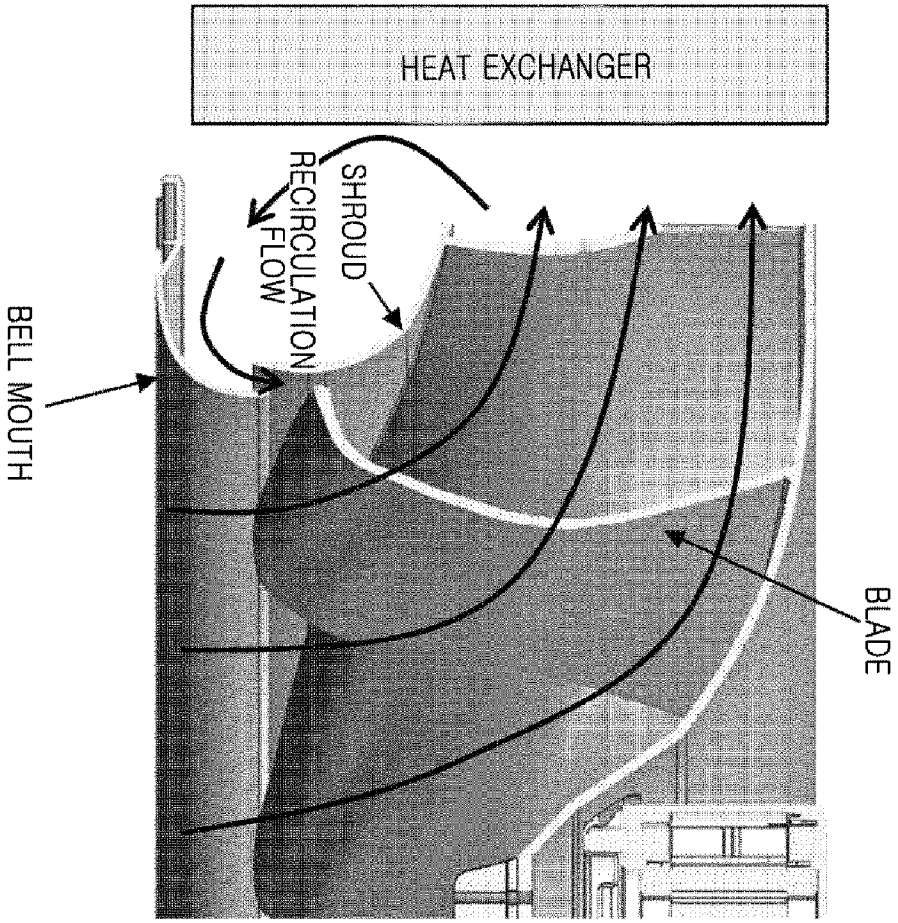
FIG. 13 is a schematic diagram illustrating a recirculation flow.

As illustrated in FIG. 13, the air blown out from the outlet of the centrifugal fan 100 becomes a recirculation flow and flows into a space (gap) between the shroud 23 and the bell mouth 24. Because the recirculation flow has a locally strong axial velocity component, a difficulty in that an inlet angle of the blade 22 does not match the recirculation flow may occur.

Figure 14A:
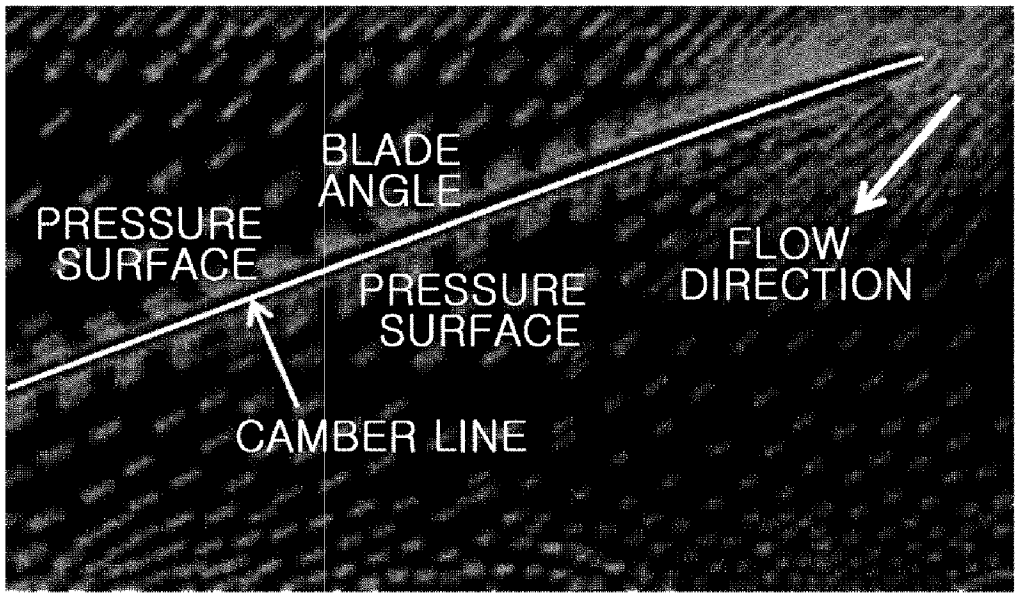
FIG. 14A is a simulation result illustrating an airflow of a configuration in which a pressure surface is not thickened.
Figure 14B:
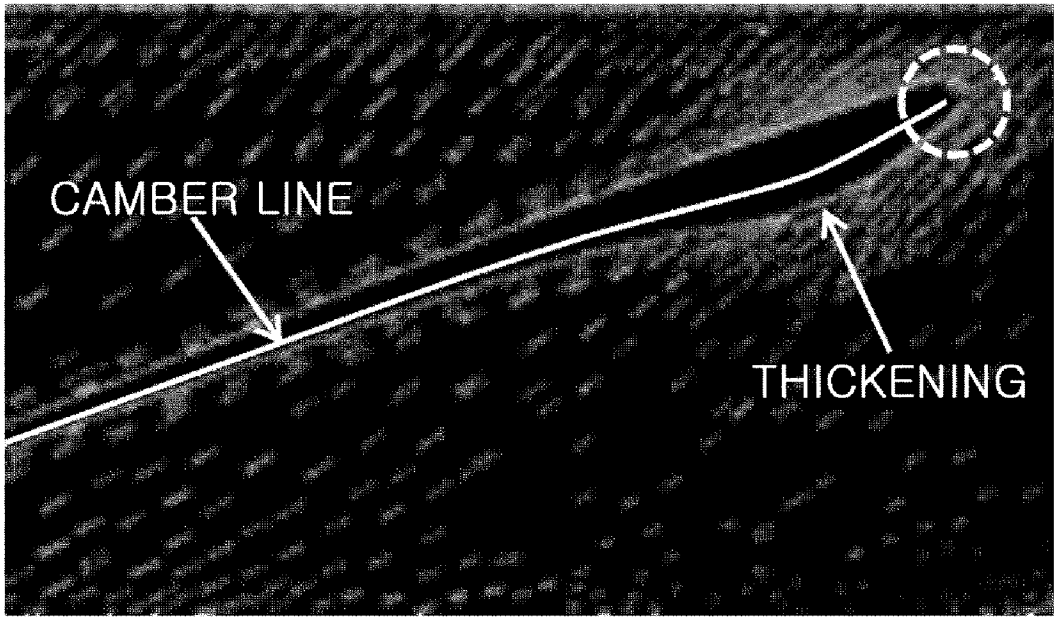
FIG. 14B is a simulation result illustrating an airflow of a configuration in which a pressure surface is thickened.

Therefore, the meridian plane passing through the rotation axis C, it is appropriate that the leading edge LE of the blade 22 is provided to allow a thickness of a region, in which the shroud 23 and the bell mouth 24 overlap in the radial direction, to be greater than a thickness of a region in which the shroud 23 and the bell mouth 24 do not overlap in the radial direction. Particularly, as illustrated in FIG. 14B, it is appropriate to thicken a pressure surface at the leading edge of the blade 22. As can be seen from a comparison between FIG. 14A and FIG. 14B, it is possible to substantially change an inlet angle of a camber line of the blade by thickening the pressure surface at the leading edge of the blade 22. As a result, it is possible to match the recirculation flow to the blade, thereby suppressing the separation of the airflow and thereby reducing the noise.

Figure 15:
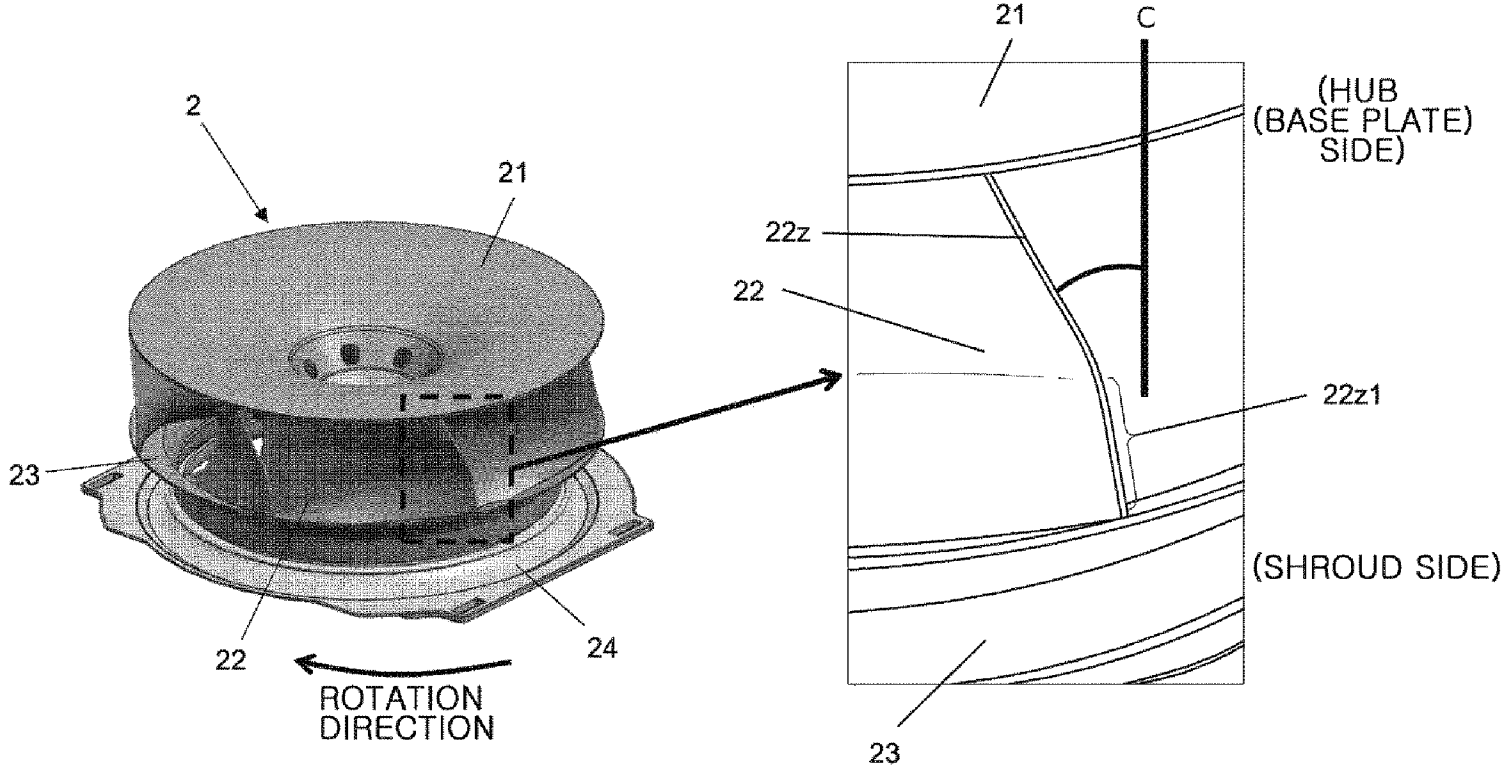
FIG. 15 is a perspective view illustrating a configuration of a trailing edge of a blade according to a modified embodiment of the disclosure.
Figure 16:
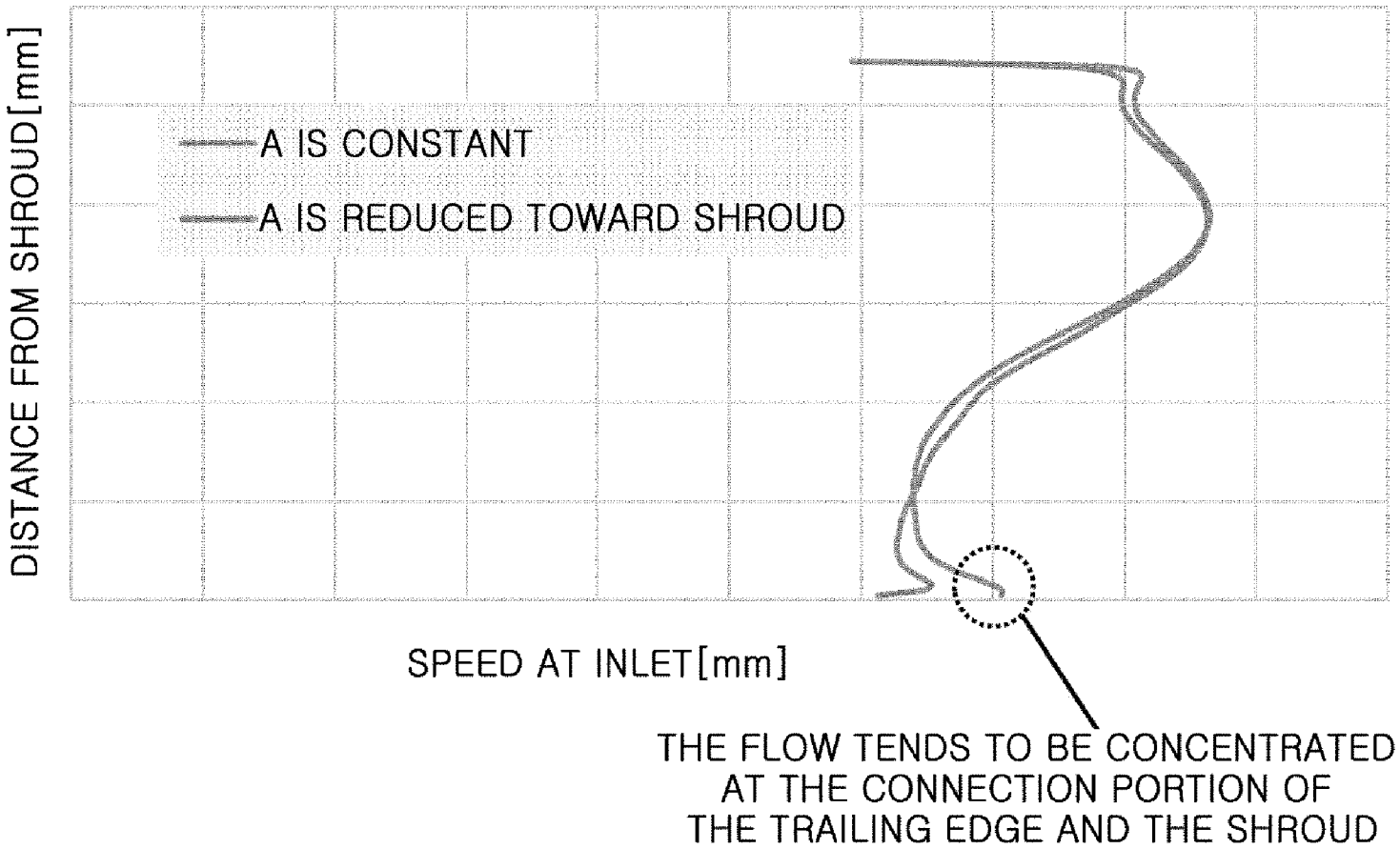
FIG. 16 is a simulation result illustrating distribution of an outlet wind speed of the centrifugal fan when the trailing edge of the blade is inclined in an opposite direction to rotation.

In order to equalize the outlet wind speed without reducing the flow rate processed on the shroud side, it is appropriate that the trailing edge 22*z* of the blade 22 is inclined to allow the shroud side to face the opposite rotation direction, as illustrated in FIG. 15. Accordingly, it is possible to induce a flow on the shroud side, thereby increasing the flow rate processed on the shroud side. In order to suppress the concentration of flow to a connection portion with the shroud 23 in the trailing edge 22*z* of the blade 22, it is appropriate that the trailing edge 22*z* of the blade 22 includes a region 22*z*1 in which an angle A between the trailing edge 22*z* and the rotation axis C is reduced toward the shroud side. By configuring in this way, as can be seen from FIG. 16, it is possible to prevent the flow being concentrated at the connection portion between the trailing edge 22*z* and the shroud 23. Therefore, power consumption and blowing noise may be improved while increasing the flow rate processed in the vicinity of the shroud as a whole.

Figure 17:
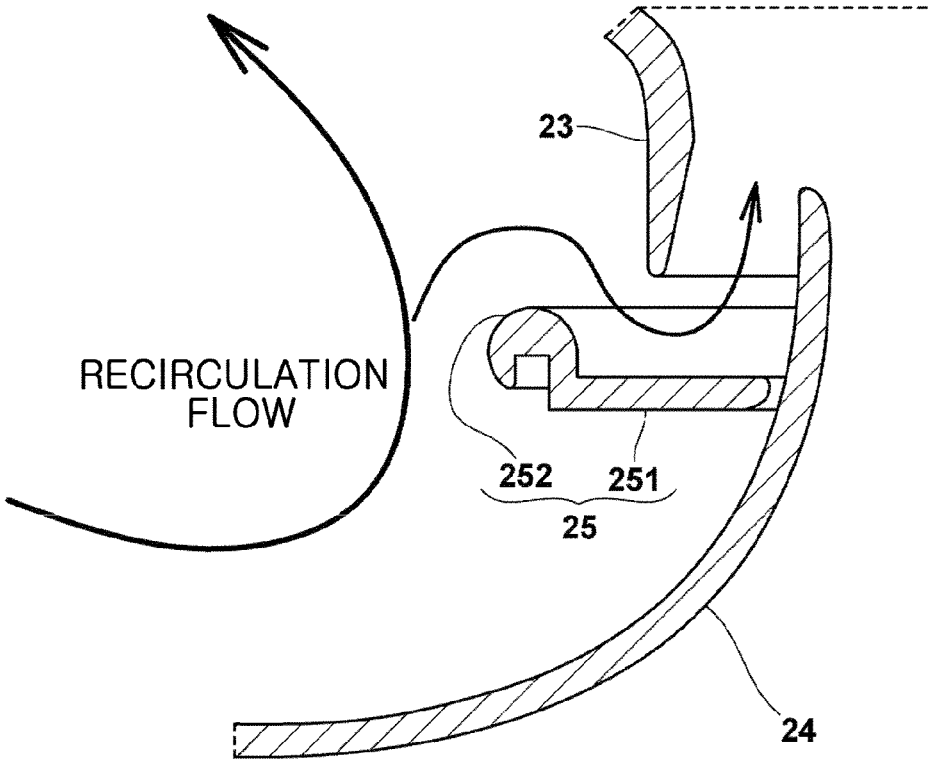
FIG. 17 is a partially enlarged cross-sectional view schematically illustrating a configuration of a modified embodiment.

As described above, the air blown out from the outlet of the centrifugal fan 100 becomes the recirculation flow and is introduced into a space (gap) between the shroud 23 and the bell mouth 24 (refer to FIG. 13). In order to reduce the recirculation flow, it is appropriate to further provide a ring-shaped member 25, which is provided by opening a gap downward from a lower end of the inlet of the shroud 23, on the outer circumference of the bell mouth 24, as illustrated in FIG. 17.

The ring-shaped member 25 is provided on the outer circumference of the bell mouth 24, and includes a ring-shaped flat plate portion 251 provided oppositely to be spaced apart from the lower end of the inlet portion of the shroud, and a protrusion 252 formed in an outer circumferential portion of a surface, which faces the shroud side, of the ring-shaped flat plate portion 251. An outer surface of the protrusion 252 is a smooth curved surface, and for example, a cross-sectional portion thereof forms a circle.

Figure 18A:
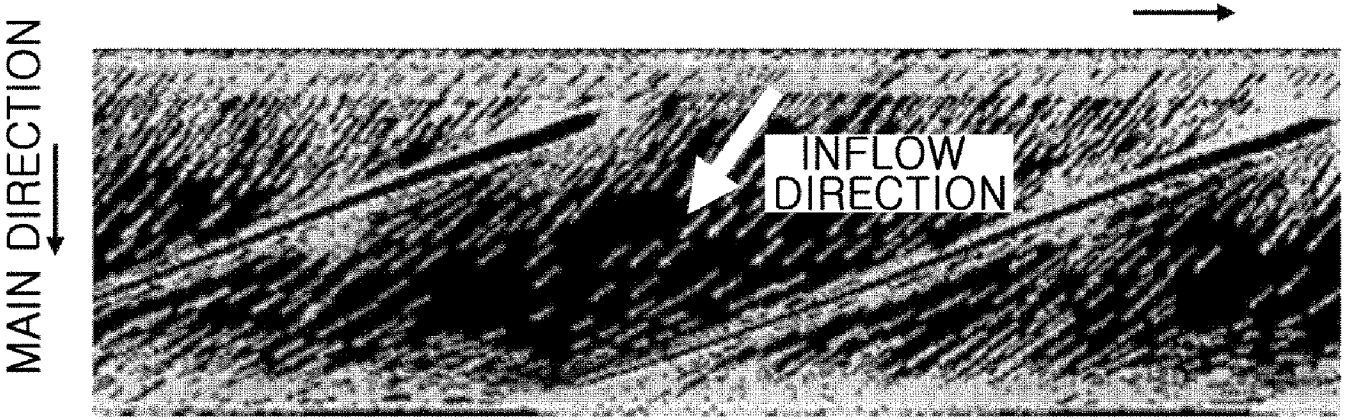
FIG. 18A is a simulation result illustrating an inflow direction in the vicinity of a recirculation flow when a ring-shaped member is not provided.
Figure 18B:
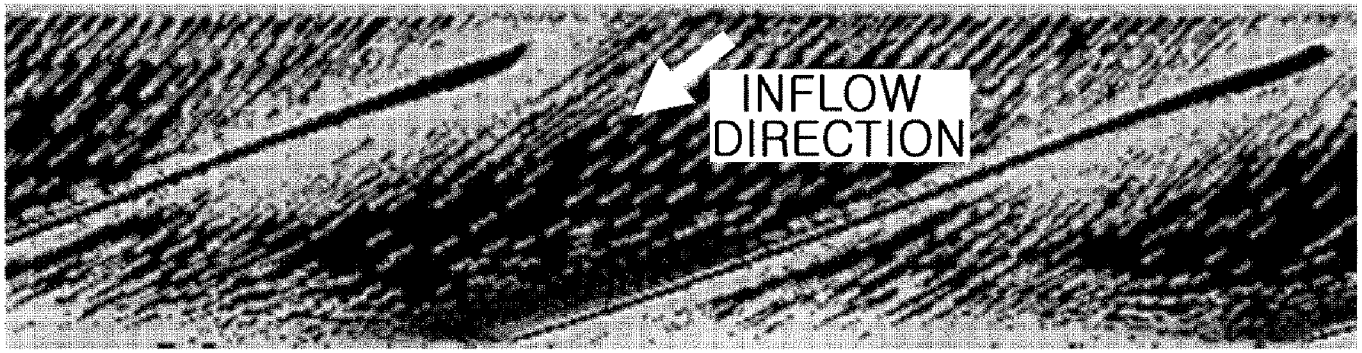
FIG. 18B is a simulation result illustrating the inflow direction in the vicinity of the recirculation flow when the ring-shaped member is provided.

As mentioned above, by providing the ring-shaped member 25, it is possible to prevent the recirculation flow from being introduced into the gap between the shroud 23 and the bell mouth 24. As a result, as illustrated in FIG. 18, the recirculation flow is reduced and an inflow angle of the recirculation flow is inclined in the direction opposite to the rotation, and thus the recirculation flow easily flows along the blade. Further, because the outer surface of the protrusion 252 includes a smooth curved surface, a flow path, through which the recirculation flow flows, is substantially S-shaped, and it is possible to prevent the turbulent in the flow path, thereby reducing the noise.

In addition, although the above embodiment has described the indoor unit for the air conditioner using the centrifugal fan, the centrifugal fan of the disclosure may be used in other blowers.

As is apparent from the above description, it is possible to improve blowing efficiency and reduce noise by suppressing the generation of turbulence in a centrifugal fan.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising:

a housing mountable to or suspendable from a ceiling and having an air intake port and an air discharge port formed on a portion of the housing;

a heat exchanger inside the housing; and a centrifugal fan inside the housing to suck air into the housing through the air intake port and discharge air to an outside of the housing through the air discharge port, wherein the centrifugal fan includes:

a base plate to which a shaft of a motor is connected, a plurality of blades joined to the base plate, and a ring-shaped shroud including an opening in a center thereof, the ring-shaped shroud joined to the plurality of blades so that the ring-shaped shroud and the base plate are spaced apart by the plurality of blades to face each other, wherein each blade of the plurality of blades includes a leading edge and a trailing edge with respect to a rotation direction of the centrifugal fan, wherein the leading edge includes a rear protruding region formed to retreat and advance in the rotation direction of the centrifugal fan from a rotation center side toward an outer circumferential side, with respect to a plane perpendicular to a rotation axis of the shaft, wherein each blade of the plurality of blades includes a first end joint portion joined to the base plate, and a second end joint portion joined to the ring-shaped shroud, wherein each blade of the plurality of blades has a twisted shape in which an outer circumferential side end of the second end joint portion is located further in the rotation direction of the centrifugal fan than an outer circumferential side end of the first end joint portion, and wherein each blade of the plurality of blades includes a rear surface portion adjacent to the opening of the ring-shaped shroud that faces the opening of the ring-shaped shroud.

2. The air conditioner of claim 1, wherein each blade of the plurality of blades includes multiple rear protruding regions.

3. The air conditioner of claim 1, wherein the leading edge includes a region continuous from the rear protruding region toward the outer circumferential side, the region formed to retract toward the outer circumferential side.

4. The air conditioner of claim 1, wherein with respect to a meridian plane passing through the rotation axis, the leading edge includes:

a first region in which an angle formed with the rotation axis is constant from the rotation center side toward the outer circumferential side;

a second region continuous from the first region to the outer circumferential side, the second region in which an angle formed with the rotation axis is reduced and then increased; and a third region continuous from the second region to the outer circumferential side, the third region in which an angle formed with the rotation axis is greater than 90 degrees.

5. The air conditioner of claim 4, wherein an angle between the leading edge and the rotation axis is an angle formed between a tangent line at one point of the leading edge and the rotation axis, the angle facing a suction side of the centrifugal fan.

6. The air conditioner of claim 4, wherein an angle between the leading edge and the rotation axis in the first region is greater than or equal to 5 degrees, but less than or equal to 30 degrees.

7. The air conditioner of claim 4, further comprising:

a bell mouth inside the ring-shaped shroud and including an inner diameter that gradually expands toward an upstream side, wherein a downstream end of the bell mouth is located at a position opposite to the third region.

8. The air conditioner of claim 1, wherein with respect to a meridian plane passing through the rotation axis, the leading edge includes:

a first region in which an angle formed with the rotation axis is constant or increased from the rotation center side toward the outer circumferential side; and a second region continuous from the first region to the outer circumferential side, the second region in which an angle formed with the rotation axis is greater than 90 degrees before being joined to the ring-shaped shroud.

9. The air conditioner of claim 8, further comprising:

a bell mouth inside the ring-shaped shroud and including an inner diameter that gradually expands toward an upstream side, wherein a downstream end of the bell mouth is located at a position opposite to the second region.

10. The air conditioner of claim 1, wherein the trailing edge is inclined so that a shroud side of the trailing edge faces a direction opposite to the rotation direction of the centrifugal fan.

11. The air conditioner of claim 10, wherein the trailing edge includes a region in which an angle between the trailing edge and the rotation axis is reduced toward the shroud side of the trailing edge.

12. The air conditioner of claim 1, further comprising:

a bell mouth inside the ring-shaped shroud and including an inner diameter that gradually expands toward an upstream side, wherein the bell mouth includes a ring-shaped member provided on an outer circumference of the bell mouth so as to be adjacent to an inlet portion of the ring-shaped shroud.

13. The air conditioner of claim 1, wherein a length of the first end joint portion is greater than a length of the second end joint portion, and with respect to the plane perpendicular to the rotation axis, an angle between a first straight line, which connects a leading edge position and a trailing edge position of the first end joint portion, and a straight line passing through a center point of the first straight line and a rotation center is less than an angle between a second straight line, which connects a leading edge position and a trailing edge position of the second end joint portion, and a straight line passing through a center point of the second straight line and the rotation center.

* * * * *